United States Patent [19]

Hansen

[11] 4,226,299

[45] Oct. 7, 1980

[54] ACOUSTICAL PANEL

[75] Inventor: Lawrence F. Hansen, Minneapolis, Minn.

[73] Assignee: Alphadyne, Inc., Minneapolis, Minn.

[21] Appl. No.: 908,545

[22] Filed: May 22, 1978

[51] Int. Cl.[3] ..... G10K 11/04; E04B 1/99

[52] U.S. Cl. ..... 181/284; 181/210; 181/286; 181/289; 181/295; 52/144

[58] Field of Search ..... 181/290, 289, 287, 295, 181/286, 291, 285, 288, 294, 284, 210; 52/144

[56] References Cited

U.S. PATENT DOCUMENTS

| | | | |
|---|---|---|---|
| 1,172,710 | 2/1916 | Howe | 181/285 |
| 1,611,483 | 12/1926 | Newsom | 181/289 |
| 2,057,071 | 10/1936 | Stranahan | 181/290 |
| 2,316,993 | 4/1943 | Sherwood | 52/304 |
| 2,811,216 | 10/1957 | Harris | 181/286 |
| 3,049,190 | 8/1962 | Coffmans | 181/287 |
| 3,294,964 | 12/1966 | Schwartz | 181/289 |
| 3,411,605 | 11/1968 | Coffman et al. | 181/30 |
| 3,498,405 | 3/1970 | Charpentier | 181/291 |
| 3,819,466 | 6/1974 | Winfield et al. | 428/175 |
| 4,094,379 | 6/1978 | Steinberger | 181/295 |
| 4,114,725 | 9/1978 | Croasdale | 181/286 |

OTHER PUBLICATIONS

Singer Partitions, Inc., "Sound Stopper Curtains or Damp Sheet".

*Primary Examiner*—L. T. Hix
*Assistant Examiner*—Benjamin R. Fuller
*Attorney, Agent, or Firm*—Merchant, Gould, Smith, Edell, Welter & Schmidt

[57] ABSTRACT

An acoustical panel for reducing acoustic noise is disclosed. The panel is comprised of a corrugated sheet of material. The sheet of material has a generally parabolic-sinusoidal configuration forming a plurality of corrugations. The corrugations extend in a first direction and form a plurality of peaks and valleys. At least one side of the panel has a surface adapted to face a source of acoustical noise. The surface acoustically diffuses acoustic waves striking the surface and causes acoustic wave interference to occur. The acoustic panel has a transaxial stiffness-compliance such that the panel is permitted to pump when low frequency acoustic energy is applied to the panel for the purpose of dissipating acoustic energy.

23 Claims, 5 Drawing Figures

ACOUSTICAL PANEL

BACKGROUND OF THE INVENTION

The invention relates broadly to panels or structural members designed to dissipate, isolate or reduce noise caused by acoustic wave energy. More specifically, the present invention relates to acoustical panels designed to reduce industrial noise generated by industrial machinery.

Acoustical panels heretofore utilized in varying degrees reflectance, interference, and/or absorption of acoustical wave energy to isolate or dissipate acoustic noise. U.S. Pat. No. 1,611,483 to Newsom illustrates sound intercepting panels which reflect objectionable noises away from an open window. At FIG. 10 of the Newsom patent, a certain amount of acoustical wave interference is illustrated. However, it appears that a major portion of the noise reduction in Newsom is accomplished by the reflection. An acoustical panel or sound intercepter which relies primarily upon the reflectance of acoustical wave energy has the disadvantage of not dissipating the acoustical wave energy, but rather merely redirecting the acoustical wave energy to another location. Of course, a certain amount of dissipation occurs merely through the transmission of the acoustical wave energy over a distance and also through the mass or isolative characteristic of the reflecting material.

U.S. Pat. No. 2,057,071 to Stranahan illustrates a sound insulating panel which utilizes the mass or isolative characteristic of a portion of the panel material and also the resistive absorption characteristic of another portion of the panel material. In Stranahan, the mass or isolative characteristic of the panel is enhanced by utilizing a heavy metal foil, such as lead foil, as outer layers of a soundproofing material. The resistive absorption is accomplished in Stranahan by utilizing an acoustic absorbing material such as felt sandwiched between the outer layers of lead foil. To increase the sound insulating capabilities of the Stranahan panel, either the mass of the lead foil is increased or the thickness of the felt is increased. Stranahan illustrates the typical drawbacks of sound insulating panels which utilize the mass characteristics or resistive absorption characteristics of material to accomplish sound insulation. That is, in order to increase the sound insulation capability of the panels, the mass or size of the panels must be increased. Hence, the panels may become either excessively heavy or excessively large.

SUMMARY OF THE INVENTION

The present invention relates to an acoustical panel for reducing acoustic noise. The panel is comprised of a corrugated sheet of material. The sheet of material has a generally sinusoidal configuration forming a plurality of corrugations. The corrugations extend in a first direction and form a plurality of peaks and valleys. At least one side of the panel has a surface adapted to face a source of acoustical noise. The surface acoustically diffuses acoustic waves striking the surface and causes acoustic wave interference to occur. The acoustic panel has a transaxial stiffness such that the panel is permitted to pump when low frequency acoustic energy is applied to the panel for the purposes of dissipating acoustic energy.

In the preferred embodiment, the corrugated sheet of material is made of a single piece of structurally rigid yet flexible lightweight material. Since the corrugated sheets are made of lightweight material, the panel does not rely primarily upon the mass or isolative characteristic of the material to reduce sound noise. By utilizing a lightweight material, the acoustic panel of the present invention can be mounted to structures and in areas where heavy sound insulation materials could not be supported.

Since a lightweight material can be utilized in constructing the acoustical panel of the present invention, a transparent or translucent plastic material can be utilized. An acoustic panel of the present invention can thus be mounted about machinery which must be observed for one reason or another. Thus, if gauges of the machinery must be read, an acoustical panel of the present invention could be situated about the machinery in such a manner that the gauges could be observed.

In the preferred embodiment, a strip of sound absorbing material is inserted in the valleys on the side of the panel which is to face a noise source. While the sound absorbing material does absorb a certain amount of the acoustical wave energy transmitted to the acoustical panel, its primary function is not to serve as a direct absorber of acoustical wave energy. Rather, the primary function of the strips of acoustical material is to serve as a medium within which acoustical wave interference can occur.

An acoustical panel of the present invention relies primarily upon elastic and acoustic reactance to reduce, isolate or dissipate acoustic wave energy rather than upon the mass or isolative characteristic of the panel material or the resistive absorption of the strip of absorbing material. The elastic and acoustic reactance results from the following factors, which will be explained more fully hereinafter: a Helmholtz resonator type of effect; acoustic diffusion; acoustic wave interference; and control of transaxial stiffness-compliance of the panel.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
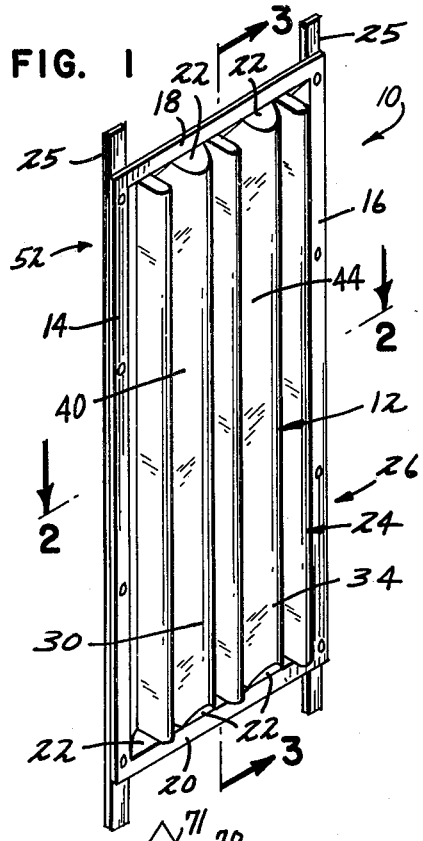
FIG. 1 is a perspective view of an acoustical panel in accordance with the present invention mounted upon a support structure.
Figure 3:
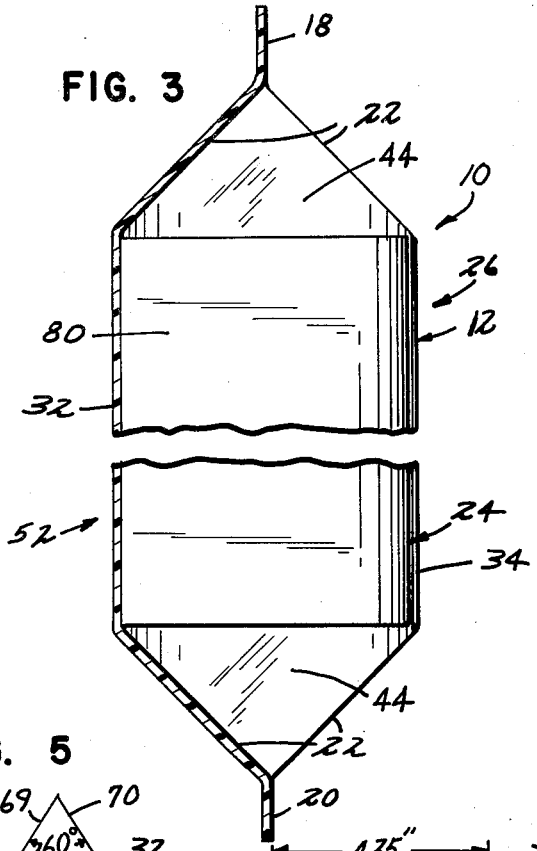
FIG. 3 is a view taken along lines 3—3 of FIG. 1.

Referring to the drawings in detail, wherein like numerals indicate like elements, there is shown in FIG. 1 an acoustical panel in accordance with the present invention designated generally as 10. The acoustic panel 10 is comprised of a generally parabolic-sinusoidal configured section 12 surrounded by side flange members 14, 16, a top flange member 18, and a bottom flange member 20. The sinusoidal section 12 and the flange members 14-20 are preferably formed from a single integral piece of material, with a plurality of generally flat connecting sections 22 connecting the top and bottom flanges 18, 20 to the sinusoidal section 12. Sound absorbing means 24, which will be described more fully hereinafter, are attached to at least a first side 26 of the panel 10.

The acoustical panel 10 is formed of a lightweight and relatively thin material. The panel 10 can be made of a lightweight material since the panel 10, as will be explained more fully hereinafter, does not rely primarily upon the mass of the panel to reduce acoustical noise. The material of which the panel 10 is constructed should be acoustically hard so that it reflects sound. The material should also be sufficiently rigid to hold its structure, yet it should be somewhat flexible.

Plastic materials which are capable of being press molded or stamped into the configuration of the panel and which have the properties described above have proved satisfactory. The plastic material is preferably transparent or translucent so that the acoustical panel 10 can be viewed through. A 3/16 inch thick clear plastic material, such as cellulose acetate butyrate, butadiene styrene and acrylonitrile butadiene styrene, have been used. When the acoustical panel 10 is made of a transparent material, the panel 10 can be mounted to machinery that must be viewed. Thus, if the operation of the machinery must be observed and/or controlled, the acoustical panel 10 permits such observation while also reducing the acoustical noise emanating from the machinery. Where visibility is not a concern, aluminum and thin gauge, cold-rolled steel or other ferrous or nonferrous material can be used.

Since the panel 10 can be constructed of lightweight material, the acoustical panel 10 can be attached in areas where heavy sound insulation material cannot be secured. Thus, the acoustical panel 10 can be secured directly to machinery which would not support a heavy mass of material, such as lead sound insulation. Also, where the machinery with which the acoustical panel 10 is to be used is already extremely heavy, the support bed for the machinery may not be capable of supporting an additional large mass. In such a circumstance, the lightweight acoustic panels 10 are especially suitable. In FIG. 1, the panel 10 is shown supported on a pair of beams 25. The beams 25 could be a portion of an independent support structure or an integral portion of the machinery with which the panel 10 is to be used.

Figure 5:
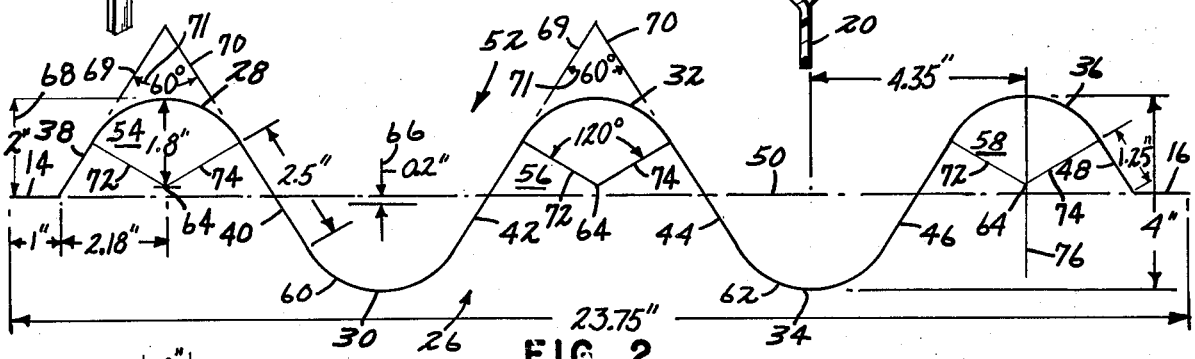
FIG. 5 is a diagrammatic view detailing the preferred curvature of the acoustical panel.

As best seen in FIG. 5, the sinusoidal section 12 is made up of a plurality of curvilinear sections 28, 30, 32, 34, and 36 and a plurality of linear sections 38, 40, 42, 44, 46, and 48. The linear sections 38, 48 connect the curvilinear sections 28, 36 to the flange members 14, 16 respectively. The remaining linear sections 40-46 interconnect opposing adjacent curvilinear sections, such as linear section 40 interconnecting curvilinear sections 28 and 30. Each curvilinear section 28-36 is formed of a segment of a circle and the mating curvilinear and linear sections approximate a parabolic function.

FIG. 5 illustrates a particular size and curvature relationship which has been found especially effective for use in industrial applications wherein the noise source is large machinery. A plane 50 passes medially of opposing curvilinear sections, such as curvilinear sections 28, 30, and forms a medial plane of the panel 10. The configuration illustrated in FIG. 5 represents the outer surface of the panel 10 to which acoustical wave energy is to be applied from the first side 26. As illustrated in FIG. 5, the curvature is symmetric about the medial plane 50 and, hence, either the first side 26 or a second side 52 could be orientated toward a noise source. As viewed from the first side 26, the panel 10 forms a plurality of corrugations having a plurality of valleys 54, 56 and 58 and a plurality of peaks 60, 62. Since the curvature of the sinusoidal section 12 is repetitive, only the portion extending from the linear section 38 to the curvilinear section 30 will be described in detail. The curvilinear section 28, which is a segment of a circle, has a center of a radius of curvature 64 which is disposed a distance 66 away from the medial plane 50. The distance 66 is approximately ten percent of the distance 68 between the medial plane 50 and the outermost extent or base of the associated curvilinear section 28. The curvilinear section 28 extends through an angular displacement of approximately 120°. The linear section 38 is aligned with a tangent line 69 of one end point of the curvilinear section 28 and the linear section 40 is aligned with a tangent line 70 at the other end of the curvilinear section 28. The tangent lines 69, 70 form an angle 71 of approximately 60 ° between one another. The angle 71 is important since it determines the deflection angle which the linear sections 38-48 present to an acoustic wave and the number of cycles of the parabolic-sinusoidal curvature per given length. A line 72 extending from the center 64 to a first end point of the curvilinear section 28 forms an angle of intersection of 90° with the linear section 38. A line 74 extending between the center 64 and a second end point of the curvilinear section 28 forms an angle of intersection of 90° with the linear section 40.

The preferred embodiment illustrated in FIG. 5 has a first or longitudinal dimension of approximately 47.625 inches, inclusive of top and bottom flange members 18, 20, and a second or width dimension transverse thereto of approximately 23.75 inches. The distance between the outermost extent of opposing curvilinear sections is approximately 4.0 inches. The distance 68 is approximately 2.0 inches and the distance 66 is approximately 0.2 inches. The radius of each of the circular curvilinear sections is therefore approximately 1.8 inches. The total distance along the curve along the second or widthwise dimension, as illustrated in FIG. 5, inclusive of the side flanges 14, 16, is approximately 33.3 inches. Since each side of flange member 14, 16 is approximately 1.0 inch in width, the total length of the sinusoidal section 12 is approximately 31.3 inches. The linear sections 38, 48 are each approximately 1.25 inches and each linear section 40, 42, 44, 46 is approximately 2.5 inches. The sinusoidal section 12 is thus made up of linear sections totalling approximately 12.5 inches and curvilinear sections totalling approximately 18.8 inches. The sinusoidal section 12 is thus formed of approximately 40% linear sections and 60% curvilinear sections.

While the above dimensions and relationships have been found especially suitable, panels constructed within the following ranges should also be operable. Applicant has found that the angle 71 is important to the acoustical performance of the panel 10. If the angle 71 is kept within the range of approximately 10° to 90°, the parabolic-sinusoidal section 12 can be varied to a pure sinusoidal configuration wherein the curvilinear sections are minimal and good acoustic noise reduction still attained. Applicant has found that optimum noise reduction is attained when the angle 71 is kept within the range of 55° angle to 70° angle. As the angle 71 decreases to the lower end of the range the isolative characteristics (noise reduction) shifts to the higher frequencies at a cost to the noise reduction at low frequencies. Conversely, as the angle 71 is increased toward the upper end of the range, the level of noise reduction at the base frequencies is enhanced and the level is reduced at high frequencies.

The acoustical panel 10 is designed to operate in the following manner. Since the acoustical panel 10 is preferably made of a lightweight material, the mass or isolative characteristic of the acoustical panel 10 plays a relatively small role in reducing the noise level or dampening the acoustic wave energy striking the panel 10. Also, since the acoustical panel 10 is constructed of acoustically hard material, the corrugated section 12 does not absorb acoustical wave energy. The acoustical panel 10 causes reduction of acoustic noise mainly through elastic and acoustic reactance resulting from the following factors: a Helmholtz resonator type of effect; acoustic diffusion; acoustic wave interference; and transaxial stiffness.

The Helmholtz resonating effect generally refers to the fact that an enclosure which communicates with an external medium through an opening of small cross-sectional area resonates at a single frequency dependent upon the geometry of the cavity. It has been found that a panel 10 configured as described above has a small dead air space at the base of the valleys 54, 56 and 58 which operate on a small scale as Helmholtz resonators. For the specific configuration described in the preferred embodiment, the Helmholtz resonator is tuned to 1,000 Hertz. The Helmholtz resonating effect increases as the panels 10 are interconnected to form an enclosure and maximizes when the panels are connected to form a total enclosure. The tuning to 1,000 Hertz is especially useful in industrial applications since the frequencies generally produced by industrial machinery approximately straddle the 1,000-Hertz frequency. When the acoustic resonance occurs, the acoustical stress at the surface of the panel is greatly reduced. The apparent mass of the material of which the panel 10 is constructed is thereby increased, resulting in enhancing the isolating characteristics of the panel 10.

Diffusion of acoustical wave energy striking the panel 10 occurs due to the irregular surface presented by the parabolic-sinusoidal section 12. A plane value of acoustic energy striking the surface of panel 10 will be reflected in an infinite number of directions, thereby dissipating the available acoustic energy.

Acoustic wave interference takes place when a sound wave strikes the corrugated contour of the panel 10 and is segregated into its frequency components (frequency bands) and is reflected from the panel 10 and superimposed on itself approximately 180° out of phase. As the sound waves are segregated, stratification of frequencies occurs along the panel 10 due, primarily, to the reaction between the sloped walls of the corrugations and the wave lengths of the incoming sound. The shorter wave lengths (higher frequencies) tend to concentrate at the bottom of the valleys 54, 56, 58 or narrowest part of the sinusoidal contour. The longer wave lengths (lower frequencies) tend to react near the peaks 60, 62 or the widest part of the sinusoidal contour.

If the acoustical panel 10 had a surface exactly contoured as illustrated in FIG. 5, theoretically the reflected frequency components could be precisely 180° out of phase with the incoming frequency components. An ideal condition for acoustic wave interference would thus be set up. However, due to manufacturing inaccuracies, a perfectly contoured surface cannot be accomplished. The reflected frequency components are thus not exactly 180° out of phase with the incoming frequency components. The sound absorbing means 24 serves as a medium within which the sound wave interference can occur even if a reflected frequency component is not exactly 180° out of phase. The absorbing means 24 serves as a type of time delay so that the criticality of an exactly out-of-phase reflected wave is not necessary for the interference to occur. This is the primary function of the sound absorbing means 24. Of course, the sound absorbing means 24 directly absorbs a portion of the incoming acoustic wave energy. However, the direct absorbing of acoustic wave energy by the sound absorbing means 24 is not a major factor in the acoustic noise reduction accomplished by the acoustic panel 10.

Figure 4:
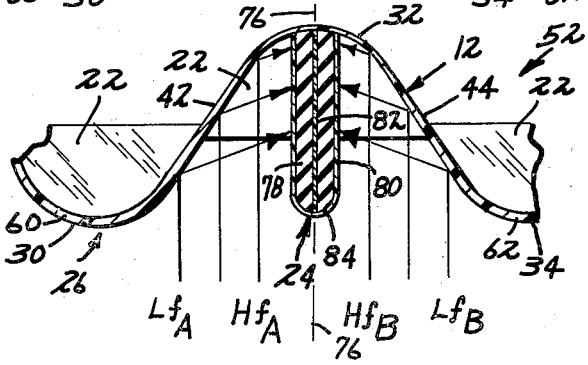
FIG. 4 is a schematic illustration of wave interference occuring with an acoustical panel of the present invention.

FIG. 4 illustrates the wave interference phenomena. Lines $Lf_A$ and $Lf_B$, and $Hf_A$ and $Hf_B$ illustrate the stratification of an incoming complex plane wave into low frequency and high frequency wave vectors. FIG. 4 schematically illustrates the interaction of the wave vectors extracted from a complex wave form. Due to the larger wave length of the lower frequency sound, the low frequency wave vectors ($Lf_A$, $Lf_B$) intercept the contour of the panel 12 at its widest point. Conversely, the high frequency wave vectors ($Hf_A$, $Hf_B$) representing the shorter wave length of the higher frequencies intercept the contour at the narrower point. In the absorbing means 24, the compression phase of a frequency component is superimposed upon the rarification phase of a frequency component, thereby negating the acoustic energy.

The sound absorbing means 24 is preferably formed of strips of acoustic foam that are secured to the base of the valleys 54, 56, 58. A plane extending perpendicularly from a tangent to the base of each of the valleys 54-58 can be considered an axial plane 76 of the corrugations. Each of the strips of acoustic foam is aligned with and extends about an axial plane 76 of each of the valleys 54-58. In the preferred embodiment, the acoustic foam is approximately 1.0 inch thick and extends from the base of each of the valleys 54-58 approximately 4.0 inches or in alignment with the peaks 60, 62. Each strip of acoustic foam is made up of a central core of acoustic foam material 78 encased by a thin film of material 80, such as MYLAR having a thickness of approximately one-half mil. The acoustical material is also preferably divided along a center plane by a septum of another piece of thin material 82 such as MYLAR of one-half mil thickness. The outer or front face 84 of each strip of acoustic foam has a curvilinear configuration. The curvilinear configuration of the front face 84 aids in guiding the acoustical wave energy to the corrugated sheet without causing reflection prior to the wave's contacting the sinusoidal section 12.

Another factor contributing to the acoustic noise reduction capability of the acoustical panel 10 is the transaxial stiffness-compliance of the acoustical panel 10. The transaxial stiffness-compliance refers to the capability of the acoustical panel 10 to flex inwardly and outwardly about the side flanges 14, 16, that is, transversely to the axial plane 76. Stiffness-compliance are complementary terms in that stiffness refers to the capability of the panel 10 to be rigid and hold its configuration, and compliance refers to the capability of the panel 10 to flex when a force, such as acoustic pressure, is applied thereto. The transaxial stiffness-compliance of a given acoustical panel 10 is determined by the type of material of which the panel 10 is formed, the thickness of the material of which the acoustical panel 10 is formed, and the thickness and width of the flanges 14-20. The flanges 14-20, especially the top and bottom flanges 18, 20, thus can serve not only as mounting means but primarily serve to determine an acoustical characteristic of the panel 10. The above factors are balanced so that the acoustical panel 10 can pump or vibrate at low frequencies, such as below approximately 160 Hertz. Through the pumping action of the panel 10, the acoustic noise reduction caused by the panel 10 at low frequencies is enhanced. By covering the acoustic foam with a thin film of acoustically reflective material ad utilizing a dividing septum of acoustically reflective material, the strips of acoustic foam also pump or vibrate at low frequencies. This enhancement is caused when a sound wave strikes the panel and forces the material of the panel and the strips of acoustic foam into a vibrational mode and energy is dissipated through frictional losses of the material, molecular air motion against the surface and a "drum head" effect of the panel and of the strips of acoustic foam. That is, acoustic energy is dissipated by converting the acoustic energy into mechanical displacement and more molecular frictional losses.

In the preferred embodiment, having the dimensions mentioned above, the transaxial stiffness-compliance sufficient for permitting the panel to vibrate at base frequencies has been attained by using a plastic material having a thickness of approximately 3/16 inch nd a specific gravity of 1.2. For other dimensioned panels, the thickness of the material, the frequency of the corrugations, and the width and thickness of the top and bottom flanges 18, 20 would have to be adjusted to permit the vibration to occur.

Figure 2:
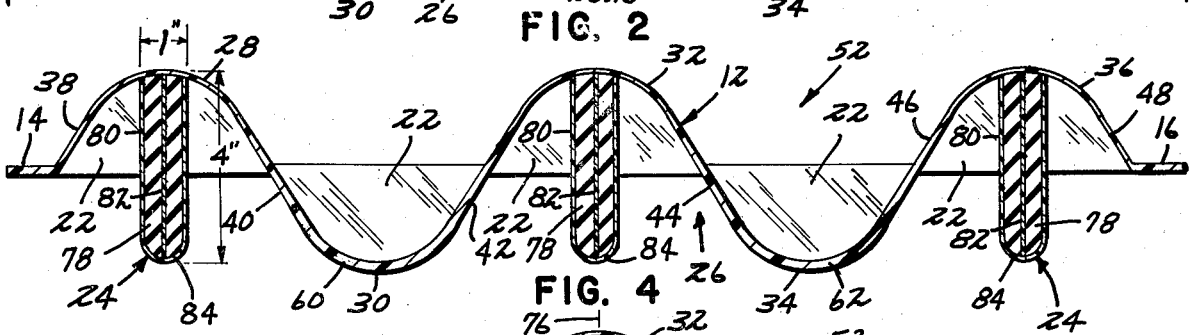
FIG. 2 is a view taken along lines 2—2 of FIG. 1.

Another factor which contributes to the acoustic noise reduction of the panel 10 is the varying thickness of the sinusoidal section 12. As seen in FIG. 2, the sinusoidal section 12 has a thin cross-sectional thickness at each of the valleys 54-58 and has a maximum thickness at each of the peaks 60, 62. As was discussed above, acoustic interference at the higher frequencies occurs within the deeper portions of the corrugations while the interference of the lower frequencies occurs further out in the wider portion of the corrugations. Through this design, the acoustical panel 10 operates most efficiently at higher frequencies, e.g., over 1,000 Hertz. Also as mentioned above, the acoustic noise reduction at lower or base frequencies is enhanced through the proper selection of transaxial stiffness-compliance. The acoustic noise reduction at the lower or base frequency is also enhanced by increasing the cross-sectional thickness of the sinusoidal section 12 at the peaks 60, 62. The mass or isolation characteristic of the panel 10 is thus increased in the area where wave interference phenomenon is not taking place and acoustical stress is at a maximum.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent extended by the broad general meaning of the terms in which the appended claims are expressed.

I claim:

1. An acoustic panel for reducing acoustic noise comprising:

means for causing acoustic wave interference of the acoustic noise to occur including a corrugated sheet having a wall of generally parabolic sinusoidal configuration made up of a plurality of curvilinear sections interconnected by a plurality of linear sections to form a plurality of corrugations wherein given sound waves over a selected frequency spectrum striking said wall are segregated into their respective frequency components and are reflected from said wall and phase shifted to meet a complementing frequency component to yield a total phase shift of approximately one hundred and eighty degrees;

said corrugated sheet being bounded by a plurality of edges and having a first dimension generally parallel to the corrugations and a second dimension generally perpendicular to the first dimension; and means connected to said edges extending along said second dimension for enabling said corrugated sheet to dissipate acoustic energy by pumping when selected low frequency acoustic energy is applied to the corrugated sheet, said means including a flange member attached to at least one of said last-mentioned edges, said flange member having selected thickness and width to establish the transaxial stiffness-compliance of said panel such that said panel pumps when acoustic energy below approximately 160 Hertz is applied to the wall of said panel.

2. An acoustic panel in accordance with claim 1 wherein said corrugations form a plurality of peaks and valleys, and said means for causing acoustic wave interference includes means for time delaying reflected sound wave frequency components comprising a strip of acoustic absorbing material secured in each of the valleys on a first side of said corrugated sheet, said first side being adapted to face a source of acoustic noise whereby acoustic wave interference can occur within said acoustic absorbing material when reflected frequency components of sound waves within said selected frequency spectrum are not exactly 180° out of phase.

3. An acoustic panel in accordance with claim 2 wherein each strip of acoustic absorbing material has a length extending substantially along the entire first dimension of each valley, each strip of acoustic absorbing material having a sufficient thickness in said second dimension for permitting interference of acoustic wave energe to occur in each of said valleys on said first side.

4. An acoustic panel in accordance with claim 1 wherein each curvilinear section is comprised of a segment of a circle having an angular extent less than 170°.

5. An acoustic panel in accordance with claim 1 wherein a plane passing medially of opposing curvilinear sections forms a medial plane of said corrugated sheet and wherein each curvilinear section has a radius of curvature and the center of each radius of curvature is disposed a distance away from said medial plane.

6. An acoustic panel in accordance with claim 5 wherein said last-mentioned distance is substantially 10% of the distance between the medial plane and the outermost extent of a respective curvilinear section, and each curvilinear section extends through an angular extent of substantially 120°.

7. An acoustic panel in accordance with claim 6 wherein each curvilinear section is comprised of a segment of a circle.

8. An acoustic panel in accordance with claim 1 wherein said corrugated sheet is formed of a single piece of structurally rigid yet flexible material and said flanges are formed integral therewith, said corrugated sheet and said flanges being sufficiently flexible to permit said corrugated sheet to vibrate when acoustic wave energy below approximately 160 Hertz is applied to the acoustic panel, whereby acoustic wave energy is dissipated.

9. An acoustic panel in accordance with claim 8 wherein said panel has a generally rectangular configuration with a length along said first dimension of approximately 47.625 inches, a width along said second dimension of approxiamtely 23.75 inches and a depth of approximately between 3.75 and B 4.25 inches.

10. An acoustic panel in accordance with claim 9 wherein said panel is formed of a plastic material, said flanges extend around the four sides of said rectangular panel.

11. An acoustic panel in accordance with claim 10 wherein said plastic material is selected from the group consisting of transparent plastic materials, opaque plastic materials and translucent plastic materials.

12. An acoustic panel in accordance with claim 1 wherein the cross-sectional thickness of said corrugated sheet varies, and wherein the thickness of the curved sections in the valleys are less than the thickness of said peaks on said first side of the corrugated sheet.

13. An acoustic panel for reducing acoustic noise comprising:

a corrugated integral sheet of acoustically hard material having a generally parabolic-sinusoidal configuration made up of a plurality of curvilinear sections interconnected by a plurality of linear sections to form a plurality of corrugations, at least 50% of said corrugations being formed of said curvilinear sections;

each curvilinear section having a first and a second end each of which joins with one of said linear sections, a first tangent line extending from said first end and a second tangent line extending from said second end intersecting to form an included angle in the range of substantially 55° to 70° to maximize the acoustic noise reduction within a selected frequency range;

said corrugations extending in a first direction and forming a plurality of peaks and valleys;

at least one side of said panel having a surface adapted to face a source of acoustical noise;

said surface forming means for acoustically diffusing acoustic waves striking said surface and for causing acoustic wave interference to occur within a selected frequency range; and said acoustic panel having a trans-axial stiffness-compliance to enable said panel to pump when low frequency acoustic energy is applied to the panel whereby acoustic energy is dissipated.

14. An acoustic panel in accordance with claim 13 wherein said curvilinear sections form the plurality of alternating peaks and valleys as viewed from said first-mentioned side of said panel, and a strip of acoustical absorbing material having a length substantially equal to the extent of the valleys in said first direction is attached in each valley on said first side of the panel.

15. An acoustic panel in accordance with claim 14 including a first thin sheet of acoustically hard material covering said acoustical absorbing material and a second thin sheet of acoustically hard material forming a septum dividing said acoustical absorbing material whereby said acoustical absorbing material vibrates to dissipate energy when low frequency acoustic wave energy strikes said panel.

16. An acoustic panel in accordance with claim 14 wherein each curvilinear section is formed by a segment of a circle having an angular extent of between approximately 110° and 125°.

17. An acoustic panel in accordance with claim 16 wherein a plane passing medially of opposing curvilinear sections defines a medial plane of said panel, each segment of a circle having a center of a radius of curvature disposed a distance away from said medial plane in a direction toward a segment of a circle associated with a center of a radius of curvature.

18. An acoustic panel in accordance with claim 17 wherein said last-mentioned distance is equal to approximately 10% of the distance between said medial plane and the outermost extent of an associated segment of a circle.

19. An acoustic panel in accordance with claim 13 including a plurality of flanges surrounding said panel, said flanges being formed integral with said corrugated sheet and contributing to the transaxial stiffness-compliance of said panel.

20. An acoustical panel for reducing acoustic noise comprising:

a corrugated sheet of material having a generally parabolic-sinusoidal configuration defined by a plurality of curvilinear sections each of which has a radius of curvature with its center disposed a distance away from a plane passing medially of opposing curvilinear sections and having an angular extent of between approximately 110° and 125° interconnected by a plurality of linear sections to form a plurality of corrugations;

said corrugations extending in a first direction and forming a plurality of peaks and valleys;

at least one side of said panel having a surface defined by the parabolic-sinusoidal configuration and adapted to face a source of acoustic noise;

said surface forming a means for acoustically diffusing acoustic waves striking said surface and for causing acoustic wave interference to occur in a selected band of frequencies.

21. An acoustic panel in accordance with claim 20 wherein said acoustic panel has a transaxial stiffness-compliance which enables said panel to pump when low frequency acoustic energy below approximately 160 Hertz is applied to the panel to thereby dissipate acoustic energy.

22. An acoustic panel in accordance with claim 21 wherein the center of each radius of curvature is disposed a distance away from said medial plane, said distance being approximately 10 percent of the distance between the medial plane and the outermost extent of a respective curvilinear section, and each curvilinear section extending through an angular extent of substantially 120°.

23. An acoustic panel in accordance with claim 22 wherein each curvilinear section is comprised of a segment of a circle.

* * * * *